US005098310A

United States Patent [19]

Avramovich et al.

[11] Patent Number: 5,098,310

[45] Date of Patent: Mar. 24, 1992

[54] ELECTRICAL CONNECTOR ASSEMBLY WITH IMPROVED WATER SEAL

[75] Inventors: Rudy Avramovich, Libertyville; Horacio A. Baggio, Niles; Simeon T. Lee; Patrick J. Stearns, both of Barrington, all of Ill.

[73] Assignee: Woodhead Industries, Inc., Northbrook, Ill.

[21] Appl. No.: 723,696

[22] Filed: Jun. 24, 1991

Related U.S. Application Data

[63] Continuation of Ser. No. 481,587, Feb. 20, 1990, abandoned.

[51] Int. Cl.[5] ..... H01R 13/52

[52] U.S. Cl. ..... 439/282; 439/519; 439/587

[58] Field of Search ..... 439/278, 282, 370, 519, 439/521, 522, 587, 588, 594

[56] References Cited

U.S. PATENT DOCUMENTS 3,665,368 5/1972 Ellis ..... 439/282

3,880,487 4/1975 Goodman et al. ..... 439/282

*Primary Examiner*—Paula A. Bradley

*Attorney, Agent, or Firm*—Emrich & Dithmar

[57] ABSTRACT

An electrical connector includes a plug assembly and a mating connector assembly. Additional protection against liquid penetration of the assembled connector is provided by a peripheral tongue-in-groove seal formed in the integrally molded housings of the plug and connector assemblies.

4 Claims, 1 Drawing Sheet

ELECTRICAL CONNECTOR ASSEMBLY WITH IMPROVED WATER SEAL

This is a continuation of application Ser. No. 481,587, now abandoned, filed Feb. 20, 1990.

Field of the Invention

The present invention relates, in general, to electrical connector assemblies. In particular, it relates to electrical connector assemblies used in electrical cord sets and having a water seal provided in the connector assembly.

As used in this field, the term "water seal" does not have a rigorous definition. It applies, in a more general sense, to a fluid seal, but there are no specifications defining, for example, the amount of fluid pressure that must be withstood by the seal. Water seals in this connection are intended primarily to prevent the entry of water into the metallic connector elements which, when assembled, provide electrical continuity between one cord and another.

Thus, an electrical connector includes a plug assembly and a connector assembly. To clarify terminology, the term "plug assembly" includes that portion of a connector having male connecting elements. A "connector assembly" includes that part of a connector having female elements or metal receptacles for receiving the male connecting elements of a plug assembly; and the combination of a plug assembly and a connector assembly are referred to simply as an "electrical connector".

There have been attempts to provide water seals for electrical connectors, and for the most part, they have been effective for preventing seepage of water into the electrical connection. However, if for any reason the prior art connectors were subjected to a pressurized flow of water, as from a hose or the like, or a driving rain, for example, seepage might occur. It is thus a principal object of the present invention to provide an improved electrical connector having an increased ability to resist leakage into the electrical connecting elements even when water is applied under pressure.

SUMMARY OF THE INVENTION

According to the present invention, the plug assembly and connector assembly of the electrical connector are each provided with integrally molded housings of a suitable elastomeric material so that the housings are flexible but provide good sealing properties. The leading edge of one of the assemblies (the connector assembly in the illustrated embodiment) is provided with a circumferential tongue. The tongue has an inner peripheral sealing surface and an outer peripheral sealing surfaces which are tapered toward each other when viewed in radial section such that the leading edge of the tongue has a lesser thickness than the base of the tongue. A circumferential rim is formed on the exterior of the connector assembly housing immediately adjacent the base of the tongue.

The housing of the plug assembly is provided with a molded circumferential skirt which defines an annular groove for receiving the tongue of the connector. The annular groove has an axial cross-section dimensioned to provide an interference fit with the tongue—that is, it is dimensioned to engage and seal with both the inner and the outer sealing surfaces of the tongue. Moreover, the foremost leading edge of the skirt lies in a radial plane and engages the corresponding surface of the rim on the connector assembly when the plug assembly and connector assembly are assembled.

Thus, the present invention provides a "labyrinth" type of seal so that any fluid which may be directed against the assembled connector under pressure must first enter in a radial direction, then be routed in one axial direction, and thence back in a radial direction, and finally in a reverse axial direction in the manner of a labyrinth.

Moreover, the seal is effective under normal use conditions even though the plug and connector assemblies are not perfectly aligned with each other, as will be understood from the detailed description. The reasons for this are the flexible, and thus "forgiving", nature of the skirt material and the V-shape of the engaging sealing surfaces, together with the fact that the tongue and groove are formed in an interference fit. This provides that a continuous, circumferential engagement for each pair of sealing surfaces.

Other features and advantages of the present invention will be apparent to persons skilled in the art from the following detailed description of a preferred embodiment accompanied by the attached drawing wherein identical reference numerals will refer to like parts in the various views.

DETAILED DESCRIPTION OF THE INVENTION

Figure 4:
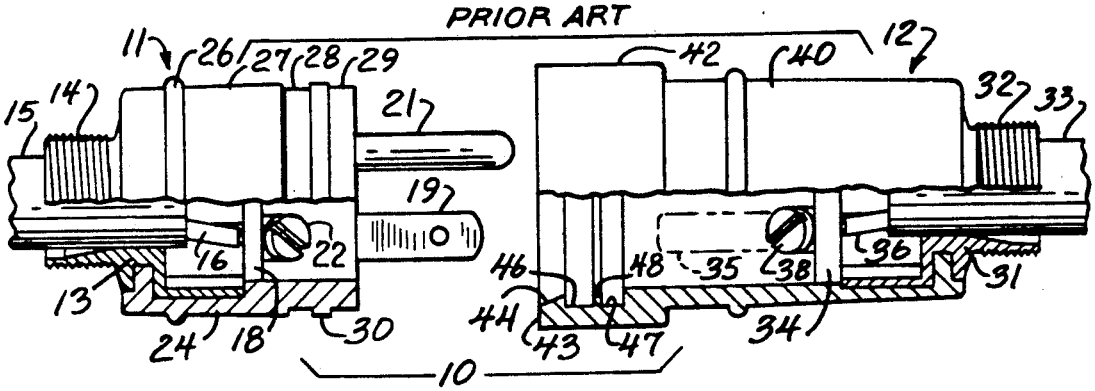
FIG. 4 PRIOR ART
FIG. 4 is a side view of a prior art plug assembly and connector assembly in exploded relation and in partial vertical cross-section.

Turning first to the prior art as seen in FIG. 4, reference numeral 10 represents an electrical connector including a plug assembly generally designated 11 and a connector assembly generally designated 12 which are in exploded or separated relation. Persons skilled in the art will recognize that the electrical connector 10 shown in the drawing is of the type conventionally referred to as a 'quick disconnect' connector. The improvement of the present invention similarly refers to quick disconnect connectors. Turning first to the plug assembly, it include a base 13 of any suitable rigid material. Base 13 has a threaded neck 14 for receiving an electrical cord 15 having a plurality of insulated wires, one of which is seen at 16.

The plug assembly also includes a removable insert 18 in which a plurality of male connecting elements such as the blade 19 and the rounded ground plug 21 are embedded. Electrical continuity is established between the wires of the cord 15 and corresponding male connecting element by conventional terminals and set screws such as that designated 22 in the drawing.

A jacket or housing 24 is integrally molded about the exterior of the base 13. The housing 24 may be provided with an exterior rounded ridge 26 to facilitate gripping and a cylindrical side wall 27. At the forward edge of the side wall 27, the housing 24 is formed into a first reduced section or groove 28 and a second or distal groove 29. The reduced sections 28, 29 are separated by a raised annular ridge 30, the purpose of which is described below.

Turning now to the connector assembly 12 as seen in FIG. 4, it also includes a rigid base 31 which has a threaded neck 32 for receiving a cord 33. The threaded necks 14, 32 of the bases are intended to receive conventional compression nuts which force compression rings and grommets to seal the bases with their associated cords, as is well known in the art and forms no part of the present invention.

The connector assembly 12 also includes a rigid connector insert 34, to which are mounted conventional metal clip receptacles such as that illustrated in dashed line at 35 for receiving and coupling to a corresponding blade connector 19. Wires such as wire 36 of the cord 33 are electrically connected to the connecting elements such as clip receptacle 35 by means of a conventional terminal and set screw one of which is seen at 38.

The connector assembly 12 includes an elongated jacket 40 which surrounds the female connector elements 35 and which provides a cavity or receptacle for receiving the plug assembly 11. The material from which the jackets 24, 40 are molded may be any suitable elastomeric material. However, a preferred material is a 70/30 blend of acrylonitrile and polyvinylchloride.

The jacket 40 of the connector assembly includes an enlarged mouth 42 which telescopically receives the jacket 24 of the plug assembly. The mouth 42 defines a flat circumferential leading surface 43. Turning now to the inner surface of the housing or jacket 40, an inner beveled surface 44 is bevelled for guiding the insertion of the plug assembly in connecting it to the connector assembly. Beveled surface 44 leads inwardly from the leading surface 43, and behind the beveled surface 44, are a first circumferential groove 46 and a second circumferential groove 47. Between the two grooves 46, 47 is a narrow circumferential lip 48.

When the plug assembly and connector assembly are connected together, the beveled surface 44 of the connector assembly jacket 12 is seated in the groove 28 of the plug assembly jacket 24 to form a first peripheral sealing zone S1. Further, the annular ridge 30 of the plug assembly jacket 24 is received in the first annular groove 46 of the connector assembly jacket 40; and the ridge 30 of the plug assembly jacket 24 engages the narrow lip 48 on the interior of the mouth 42 of the jacket 40 of the connector assembly so that the lip is forced against the wall of the groove 29 to form a second peripheral sealing zone S2. The first and the second seal zones S1 and S2 of the prior art can be seen in FIG. 3.

Figure 1:
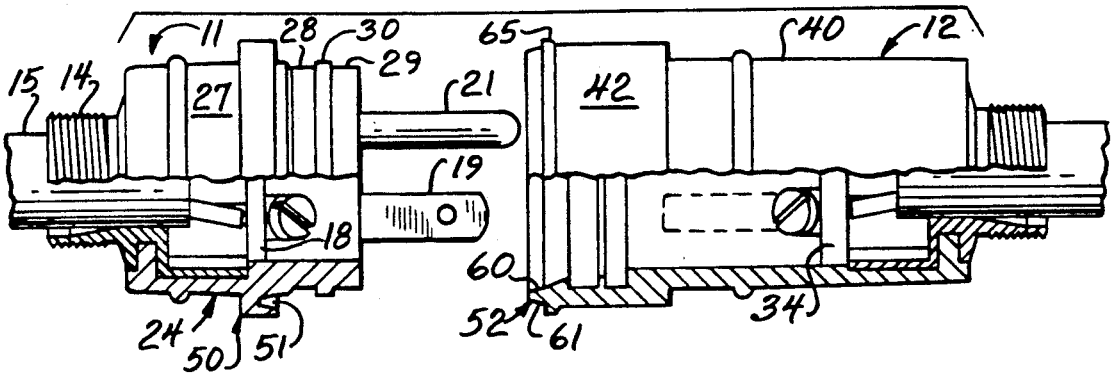
FIG. 1 is side perspective view of a plug assembly and a connector assembly in exploded relation and each shown in partial vertical cross-section.
Figure 2:
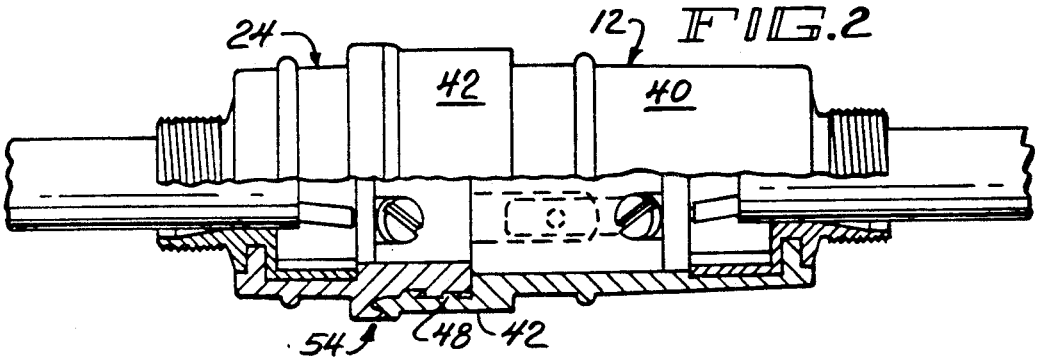
FIG. 2 is a view similar to FIG. 1 but with the connector assembly and plug assembly in assembled relation.
Figure 3:
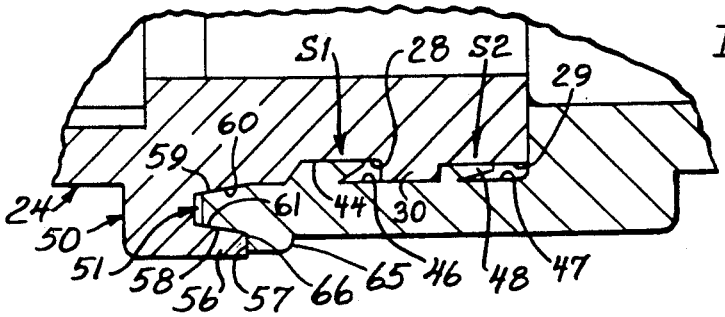
FIG. 3 is an enlarged fragmentary view of the tongue-in-groove seal formed by the plug assembly and connector assembly in assembled relation, in vertical cross-section.

Turning now to FIGS. 1-3, the improved electrical connector of the present invention is illustrated. For brevity, those elements of the prior art which are carried over into the improved structure are illustrated in FIGS. 1-3 and bear the same reference numeral as the corresponding structure in FIG. 4. Thus, the structure which is repeated in the improvement has already been described and need not be further described for those skilled in the art to appreciate the improvement.

The improvement of the present invention contemplates the formation of an exterior peripheral skirt generally designated 50 which defines an annular groove 51 for receiving a corresponding annular tongue generally designated 52 formed on the leading edge of the housing 40 of the connector assembly, thus forming a tongue-in-groove seal generally designated 54 in FIG. 2 when the plug assembly and connector assembly are connected.

Turning now to FIG. 3, the peripheral skirt 50 is integrally molded with the housing 24 of the plug assembly and includes a peripheral flange 56 having a leading edge 57 which, in the illustrated embodiment, is flat, although it may be curved, if desired. The flange 56 partially defines the groove 51 by forming a first inclined surface 58. The body of the housing 24 forms a second inclined surface 59 further forming the groove 51. The surfaces 58, 59 of the groove 51 are tapered at approximately 10° to form a slight V-shape in axial cross-section.

Turning now to the tongue 52, it is formed on the leading edge of the housing 40, as mentioned, and includes inner and outer peripheral surfaces 60, 61 which are tapered in axial cross-section, and they are dimensioned to form an interference fit with and seal against the corresponding tapered surfaces 59, 58 respectively of the groove 51, as best seen in FIG. 3. Thus, the surfaces 59 of the groove 51 and 60 of the tongue 52 form an inner peripheral seal, and the corresponding surfaces 58, 61 form an outer peripheral seal. As best seen in FIG. 3, the foremost leading edge of the tongue 52 is spaced slightly from the innermost surface of the groove 51 to permit complete engagement of these sealing surfaces. An outer circumferential ridge 65 is formed at the base of the tongue 52; and the rim 65 defines a leading edge 66 which extends in a radial plane and abuts the corresponding surface 57 of the flange 56 of skirt 50.

As mentioned, the tongue and groove are dimensioned such that an interference fit, as distinguished from a clearance fit is formed to better enhance the sealing properties. The tongue-in-groove seal thus described forms a labyrinthtype seal in that water, in order to penetrate the seal, must first travel radially inwardly between the surfaces 57, 56 and thence in a leftward axial direction between cooperating surfaces 58, 61, thence radially inwardly again at the base of the groove 51, thence axially toward the right in FIG. 3 between cooperating surfaces 59, 60. This labyrinth-type seal enhances the ability of the assembled connector to resist leakage of pressurized water. Moreover, by providing flush, engaging surfaces 57, 66 respectively on the plug assembly jacket and the connector assembly jacket, there is no trough for the collection liquid as was formed by the perpendicular surfaces of the prior art—namely, the leading edge 43 of the connector assembly jacket and the outer peripheral surface of the portion 27 of the plug assembly.

It will thus be appreciated by persons skilled in the art that the present invention provides a tongue-in-groove seal for an electrical connector which enhances the ability of the connector to resist leakage or seepage of water, even if the water is applied under pressure, into the interior of the connector, yet which maintains the two peripheral sealing areas in the prior art. Having thus disclosed in detail a preferred embodiment of the invention, persons skilled in the art will be able to modify certain of the structure which has been illustrated and to substitute equivalent elements for those described while continuing to practice the principle of the invention; and it is, therefore, intended that all such modifications and substitutions be covered as they are embraced within the spirit and scope of the appended claims.

We claim:

1. In a quick disconnect electrical connector including a plug assembly comprising a plug base, a plug insert having a plurality of male connecting elements and a plug housing integrally molded of elastomeric material to the exterior of said plug base, and a connector assembly comprising a connector base, connector insert having a plurality of receptacle connecting elements for electrically coupling with corresponding ones of said male connecting elements and a connector housing integrally molded of elastomeric material to the exterior of said connector base, an improved liquid seal comprising: one of said housings forming a circumferential tongue at the leading portion thereof, said tongue having an inner and an outer sealing surface, said sealing surfaces being tapered toward each other when viewed in axial section such that the leading edge of the tongue has a lesser thickness than the base of the tongue, a peripheral rim integrally molded on the outer surface of said one housing adjacent the base of said tongue and defining a circumferential flat annular surface; and the other of said housings having a peripheral skirt forming an annular groove defining a first and a second sealing surface constructed and arranged to engage and seal with said inner and outer sealing surfaces of said tongue respectively in an interference fit, the foremost leading edge of said skirt defining a corresponding circumferential flat annular surface for engaging said circumferential flat annular surface of said tongue and the leading edge of said tongue being spaced slightly from the innermost depth of said groove in said skirt whereby a labyrinth seal of three pairs of continuously engaging surfaces is formed when said plug assembly is assembled to said connector assembly.

2. The connector of claim 1 wherein said skirt includes a peripheral base integrally molded with the other of said housings and a flange depending from said base to at least partially define said annular groove.

3. The connector of claim 2 wherein the sealing surfaces of said tongue are tapered at an angle of approximately 10° relative to a line parallel to the axis of said connector.

4. The connector of claim 3 wherein said elastomeric material is a blend of acrylonitrile and polyvinylchloride.

* * * * *